United States Patent [19]

Holzhauer

[11] 3,968,725

[45] July 13, 1976

[54] HIGH STRENGTH, LOW STRETCH BRAIDED ROPE

[75] Inventor: Henry J. Holzhauer, Spirit Lake, Iowa

[73] Assignee: Berkley & Company, Inc., Spirit Lake, Iowa

[22] Filed: Dec. 13, 1974

[21] Appl. No.: 532,457

[52] U.S. Cl. ..... 87/6; 57/140 BY; 57/144; 87/9

[51] Int. Cl.[2] ..... D04C 1/12

[58] Field of Search ..... 87/5–9; 57/140 BY, 144, 146, 147, 160

[56] References Cited

UNITED STATES PATENTS

| | | | |
|---|---|---|---|
| 2,979,982 | 4/1961 | Weitzel | 87/6 |
| 3,030,851 | 4/1962 | Meyer | 87/6 |
| 3,035,476 | 5/1962 | Fogden | 87/6 X |
| 3,036,490 | 5/1962 | Muller et al. | 87/6 |
| 3,078,755 | 2/1963 | Chace, Jr. | 87/9 |
| 3,155,768 | 11/1964 | Garshick | 87/6 X |

*Primary Examiner*—John Petrakes
*Attorney, Agent, or Firm*—Orrin M. Haugen

[57] ABSTRACT

A multi-filament rope which comprises a blend of filaments braided together to form a composite line structure. The core of the structure consists primarily of polyimide of an aromatic tetracarboxylic acid dianhydride, with the sheath consisting primarily of polyolefin fibers selected from the group consisting of polypropylene and polyethylene braided over the core.

4 Claims, 2 Drawing Figures

HIGH STRENGTH, LOW STRETCH BRAIDED ROPE

BACKGROUND OF THE INVENTION

The present invention relates generally to an improved rope structure, and more specifically to a composite rope structure having a core consisting primarily of high modulus fibers, and a sheath consisting primarily of a relatively lower modulus fiber having high abrasion resistance.

The fibers comprising the core are, as indicated, primarily high modulus fibers while the fibers comprising the sheath are relatively lower modulus fibers having high abrasion resistance. The composite structure has been found to provide a finished product having properties which exceed the sum of the individual parts, thereby providing and contributing to a synergistic effect in the overall finished product.

In the preparation of ropes or lines, the utilization of high modulus fibers alone normally provides two disadvantages, the first being the high specific gravity of these fibers, the second being the generally low abrasion resistance. For certain applications, such as utilization as a water ski-tow rope, the use of high modulus fibers may provide a finished product with a specific gravity greater than 1.0, thereby having a non-floating line. Furthermore, the low abrasion resistance of these fibers limits or restricts the application of the finished line for a wide variety of uses.

The utilization of lower modulus fibers will, of course, provide a specific gravity normally less than 1, however the stretch characteristics of such fibers when braided into a line also limits the application of the braided product. In the present structure, a high modulus core is covered with a sheath of a different fiber having high abrasion resistance and low specific gravity, thereby achieving a finished rope product with a specific gravity less than 1, and having high strength and low stretch.

The core material is preferably prepared from fibers which consist essentially of a polyimide of an aromatic tetracarboxylic acid dianhydride having the recurring unit with the structural formula:

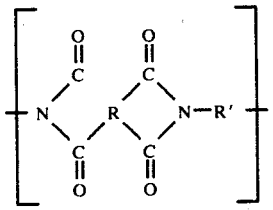

wherein R is a tetravalent aromatic radical, and wherein R is a divalent benzenoid radical. Fibers of such polyimide materials are co-mercially available. The sheath material, as indicated, consists primarily of filaments of a polyolefin selected from the group consisting of polypropylene and polyethylene. Such polyolefin filaments are, of course, commercially available.

Therefore, it is a primary object of the present invention to provide an improved composite rope structure having low stretch, high strength, and high abrasion resistance.

It is a further object of the present invention to provide an improved braided rope structure which comprises a blend of filaments braided together to form the composite line structure, and including a braided core of filaments having a high modulus and a sheath braided thereover, the sheath comprising filaments of lower modulus, but significantly higher abrasion resistance.

It is a further object of the present invention to provide an improved rope comprising a plurality of discreet filaments, the filaments being arranged in a core and sheath structure, the composite of which forms a high strength core and a high abrasion resistance sheath, and with the composite structure having high strength and low stretch characteristics.

Other further objects of the present invention will become apparent to those skilled in the art upon a study of the following specification, appended claims and accompanying drawings.

DESCRIPTION OF THE PREFERRED EMBODIMENT

Figure 1:
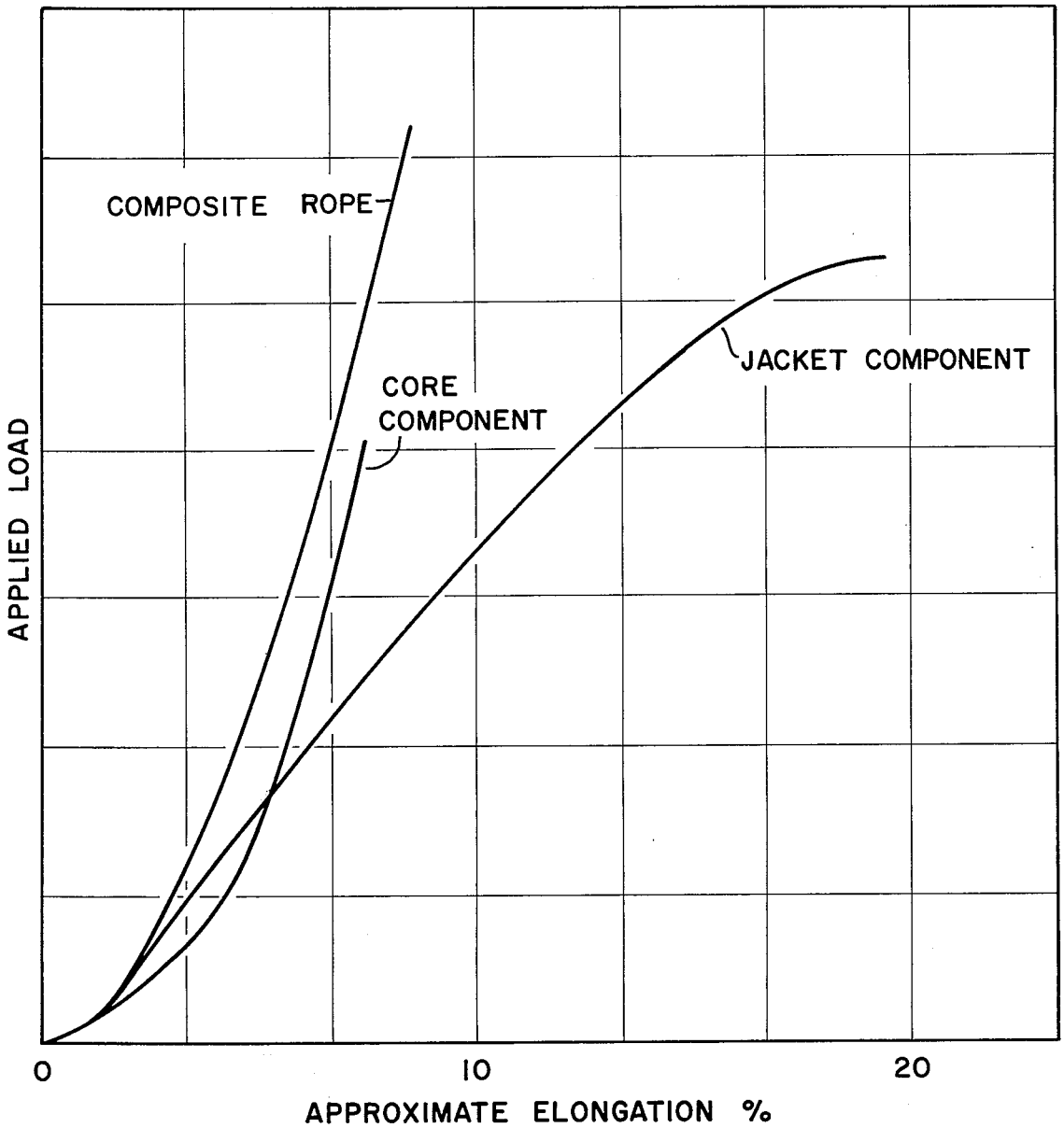
FIG. 1 is a graph illustrating the elongation in percent as a function of test load, for a number of test samples.
Figure 2:
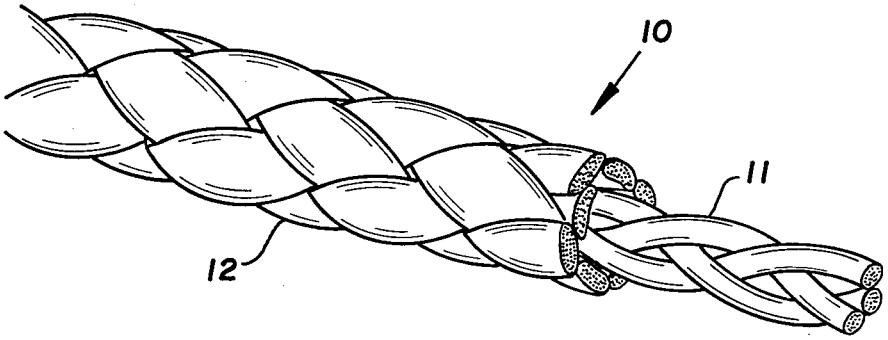
FIG. 2 is a perspective view of a typical rope prepared in accordance with the present invention.

In accordance with the preferred embodiment of the present invention, and with particular attention being directed to FIG. 2 of the drawings, it will be seen that the rope structure generally designated 10 comprises an inner core component 11 along with an outer sheath component 12. Core 11 is comprised of a plurality of multi-filament yarns braided together in a diamond braid construction. The term "multi-filament" is being utilized in a comprehensive sense, and refers to the plurality of filaments employed in the preparation of the composite line structure. In order to enhance the flexibility of the composite product, and to enable splicing of the finished rope, it has been found desirable to add a quantity of relatively low modulus fibers, such as polypropylene to the core braid. The sheath construction is essentially a braid of multi-filament yarn of relatively low modulus but high abrasion resistant material, with the filaments forming the sheath material consisting of polypropylene. It will be appreciated, of course, that polyolefins may be employed for the sheath construction, with polyethylene being suited for application to the sheath.

In preparing a preferred composite structure with specific application to a ski-tow rope, the following yarns were employed:

1. 15 filament .007 polypropylene
   Denier - 3,600
   Test - 40 lbs.
2. 60 filament .007 polypropylene
   Denier - 14,400
   Test - 160 lbs.
3. 100 filament polyimide
   Denier - 1,500
   Test - 65 lbs.

Each of these filamentary materials is commercially available, with the polypropylene material being widely available, and with the 100 filament polyimide yarn being available from E. I. DuPont de Nemours Corp., Wilmington, Delaware, under the code name "Kevlar DP-01." In order to fabricate this structure into a composite rope, the following operations are conducted.

CORE CONTRUCTION

One yarn of 15 filament 0.007 polypropylene and two yarns of 1500 denier polyimide are spooled together on braider bobbins. These yarns are then braided together in a diamond braid construction. The presence of polypropylene in the core renders it more easily spliceable, thus making a braided core that can be entered with a splicing fid. It has been found that the high modulus fibers of polyimide do not remain firmly in place, thus rendering the material difficult to treat with a splicing fid.

SHEATH CONSTRUCTION

Yarn comprising 60 filament 0.007 polypropylene fibers is braided over the core material. While other filament counts may be employed, it has been found that the specific combination herein provides the best results when employed on eight carrier braiders. The core is preferably passed upwardly through the center of the eight carrier braider whereupon the sheath is braided thereover.

PHYSICAL PROPERTIES

In the composite material provided, the following physical properties of components and composite are provided:

Core
Picks per foot - 30
Diameter - .150 inches
Yield - .44 lbs. per 100 foot
.21 lbs. propylene
.23 lbs. Kevlar
Test - 820
Elongation - 9.6%
Sheath
Picks per foot - 30
Yield - .66 lbs. per 100 foot
Test - 1,450
Elongation - 22%
Composite Rope
Picks per foot - 30
Diameter - .300 inch
Yield - 1.1 lbs. per 100 foot
.87 lbs. polypropylene
.23 lbs. Kevlar
Test - 1,260
Elongation - 9%

From this data, it is apparent that the physical properties of the composite exceed that of the sum of the components.

POLYIMIDE FIBERS

As has been indicated, the polyimide fibers are characterized by a structure having a repeating unit with the following structural formula:

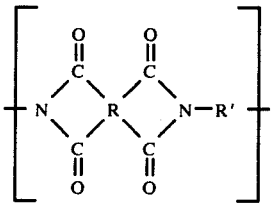

wherein R is a tetravalent aromatic radical, and wherein R is a divalent benzenoid radical. Aromatic polyimides of this type and the process of preparing them are disclosed in U.S. Pat. No. 3,179,634, and reference is made to that patent for a disclosure of the process for preparing typical polyimides of this type.

ALTERNATE CONSTRUCTIONS

While it has been indicated that the core material be braided, it will be appreciated that the core may be prepared from fibers or yarns having generally parallel orientation, as well as twisted orientation. It will be appreciated, however, that the braided core will provide ideal peformance for water ski use. In the utilization of a twisted core, generally similar preparation techniques will be employed, with the exception of the formation of the twisted core.

As has been indicated, polyolefins are preferred for materials of construction for the fibers forming the sheath, and hence in lieu of the polypropylene employed in the specific example herein, polyethylene may be employed as a direct substitute for the polypropylene and in the same filamentary diameter.

As has been indicated, the term "multi-filament" has been utilized in a comprehensive sense, and thus it will be appreciated that the core may be prepared from woven multi-filaments, or alternatively from braided or twisted filaments generally known as "monofilaments" in the industry. It will be appreciated, therefore, that reference to the term "multi-filament" is not intended to limit or restrict such structures to those having a diameter of 0.003 inches or less.

Inasmuch as the densities may vary from yarn to yarn the ratio of materials utilized in the preparation of the composite structure may be modified or selected so as to achieve a specific gravity within any desired useful range. For water ski tow ropes, of course, a specific gravity of less than 1 is desired in order to assure a floating line.

WATER SKI-TOW APPLICATION

In a water ski-tow application, the rope has high strength, low elongation or stretch, and high abrasion resistance. Under typical water skiing conditions, the load applied to the rope varies significantly from time to time, particularly when the skier is engaged in a slalom event. If the rope has relatively high elongation or stretch, the performance of the skier may be compromised due to the slower response of the tow rope. With the lower stretch material of the present invention, the response time is significantly shortened and the skier may perform unusual movements with a greater degree of predictability and more uniform response.

I claim:

1. Multi-filament line means comprising a blend of filaments braided together to form a composite line structure and including a core with a multi-filament sheath braided thereover;

a. said core comprising the combination of a first and a second plurality of filaments combined together with said first plurality of filaments consisting essentially of a polyolefin selected from the group consisting of polypropylene and polyethylene, and with said second plurality of filaments consisting essentially of polyimide of an aromatic tetracarboxylic acid dianhydride having the recurring unit with the structural formula:

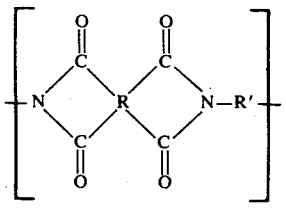

wherein R is a tetravalent aromatic radical, and wherein R is a divalent benzenoid radical;

b. said sheath comprising a plurality of filaments braided together and consisting essentially of polypropylene.

2. The multi-filament line means as defined in claim 1 being particularly characterized in that the filaments of said core are braided together.

3. The multi-filament line means as defined in claim 1 being particularly characterized in that said core and said sheath comprise a plurality of multi-filament yarns braided together to form said core and said sheath.

4. Multi-filament line means comprising a blend of filaments braided together to form a composite line structure and including a core with a multi-filament sheath braided thereover;

a. said core comprising a plurality of filaments consisting essentially of a polyimide of an aromatic tetracarboxylic acid dianhydride having the recurring unit with the structural formula:

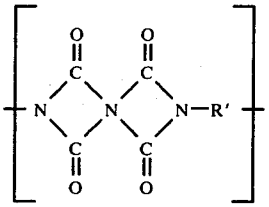

wherein R is a tetravalent aromatic radical, and wherein R is a divalent benzenoid radical;

b. said sheath comprising a plurality of filaments braided together and consisting essentially of a polyolefin selected from the group consisting of polypropylene and polyethylene.

* * * * *